United States Patent [19]

Gartzke

[11] Patent Number: 4,672,342

[45] Date of Patent: Jun. 9, 1987

[54] METHOD AND MEANS OF CONSTRUCTION OF A COAXIAL CABLE AND CONNECTOR-TRANSFORMER ASSEMBLY FOR CONNECTING COAXIAL CABLES OF DIFFERENT IMPEDANCE

[76] Inventor: Donald G. Gartzke, 133 Rock Maple Ave., Hamilton, Mass. 01936

[21] Appl. No.: 759,760

[22] Filed: Jul. 29, 1985

[51] Int. Cl.[4] ..... H01P 1/04

[52] U.S. Cl. ..... 333/260; 333/34; 439/578

[58] Field of Search ..... 333/245, 260, 261, 33, 333/34; 339/177 R

[56] References Cited

U.S. PATENT DOCUMENTS

| | | | |
|---|---|---|---|
| 2,540,012 | 1/1951 | Salati | 333/260 |
| 2,983,779 | 5/1961 | Dumire et al. | 339/177 R X |
| 3,292,117 | 12/1966 | Bryant et al. | 339/177 R X |
| 3,325,752 | 6/1967 | Barker | 333/260 X |
| 4,019,802 | 4/1977 | Shannon et al. | 339/177 R |
| 4,365,214 | 12/1982 | Shillady | 333/245 X |
| 4,370,630 | 1/1983 | Capek et al. | 333/260 X |

*Primary Examiner*—Paul Gensler

*Attorney, Agent, or Firm*—Robert T. Dunn

[57] ABSTRACT

A Super High Frequency (SHF) coaxial cable and connector assembly for connection of the coaxial cable thereof to a relatively low impedance circuit, such as a YIG filter for which the connection impedance is on the order of ten ohms, has a connector providing a port for receiving a conventional fifty ohm coaxial cable plug and includes: a ten ohm SHF coaxial cable having a metal ferrule soldered to the outer conductor at the connector end thereof providing a substantially larger diameter outer conductor at that end than the outer conductor of the ten ohm cable; and a coaxial connector having a coaxial recess in the housing thereof at one end to accommodate the cable ferrule and into which the ferrule is force-fit to make an intimate metal to metal contact therewith, while the ten ohm cable center conductor engages the connector center conductor within the recess; the inside diameter of the metal walls of the ferrule and the coaxial connector housing from the one end of the connector (where the ferrule is attached), to the port at the other end becoming progressively larger and forming a transformer from ten ohm to fifty ohm coaxial line, so that the port end of the connector accepts and matches a conventional fifty ohm SHF coaxial cable plug.

14 Claims, 7 Drawing Figures

METHOD AND MEANS OF CONSTRUCTION OF A COAXIAL CABLE AND CONNECTOR-TRANSFORMER ASSEMBLY FOR CONNECTING COAXIAL CABLES OF DIFFERENT IMPEDANCE

BACKGROUND OF THE INVENTION

This invention relates to coaxial connectors for connection to coaxial cable plugs and more particularly to a coaxial cable and connector assembly for connection to a Super High Frequency (SHF) low impedance (Zl) electrical circuit element for conducting SHF signals between the element and a coaxial port of the connector that accepts and matches a conventional relatively high impedance (Zh) coaxial cable.

Heretofore, a coaxial cable and connector assembly for direct connection of the cable part thereof to a low impedance (ten ohm), high frequency circuit element operating in the SHF range of 0.5 to 20 GHz and higher has been provided to users in the form of a coaxial cable four to six inches long with a conventional fifty ohm coaxial connector at one end. The cable is of special construction and incorporates a series of transformer steps from the ten ohm end that connects to the SHF circuit element to the fifty ohm end attached to the conventional fifty ohm connector that provides a port for a fifty ohm coaxial cable plug. The object here is to use a conventional fifty ohm SHF connector for the port and so the cable to the SHF circuit element is of special construction and contains a ten to fifty ohm coaxial transformer to insure acceptable voltage standing wave ratio (VSWR) at SHF operation.

It has been the practice to make the special cable of a length of Number 070, 10 ohm coaxial cable by disassembling the cable, machining the center conductor to form transformer steps, boring the dielectric to fit the machined center conductor and then, reassembling the cable for attachment to the connector. Clearly, this cable and connector assembly cannot be made with a connector at each end of the special cable to provide the user with two cable and connector assemblies by cutting the cable at a suitable point between the two connectors as described in my co-pending U.S. patent application Ser. No. 686,932, filed Dec. 27 1984 and entitled "Method And Means of Construction of Coaxial Cable And Connector Assembly". The product described in that application provides the user with two 50 ohm to 50 ohm SHF cable and connector assemblies for providing two coaxial ports to the circuit.

At SHF frequencies of 0.5 to 20 GHz, or higher, the cable of the assembly is as small as Number 070 50 ohm cable (0.070 inches in diameter) and the threads of the connector attached to the cable are 7/16 inch by 28 threads per inch and so the connector is also quite small. My co-pending application teaches a technique of connecting an even smaller cable and connector so that the two fit together in intimate electrical and mechanical contact that withstands separation forces specified, without soldering the cable and connector together.

The technique described in my said co-pending application is used to provide a 50 ohm impedance electrical connection to SHF circuit elements such as a YIG filter These assemblies are sometimes called "YIG cable assemblies". They provide a connection to the YIG filter for a conventional fifty ohm coaxial cable plug external of the YIG circuit. As described in that application, the cable assembly is provided with a length of fifty ohm cable (Number 047, 50 ohm), four to six inches long and a fifty ohm connector attached to each end. The user cuts the cable to the length desired and uses each half to make a connection for a conventional fifty ohm coaxial cable port. Each is used by baring the fine, wire-like center conductor of the cable a sufficient length for attachment to the YIG filter.

Prior to my invention described in my co-pending application, such a cable assembly was made by inserting a bared end of the Number 047, 50 ohm cable with the wire-like center conductor thereof projecting, into an accommodating end of a fifty ohm connector so that the center conductor of the cable would fit inside a spring finger at that end of the connector center conductor. Then, the outer conductor of the cable was soldered to the connector housing. Following that, epoxy was applied around the connector center conductor, dielectric and housing through a hole provided therein to fix them in position and so insure that radial and axial alignments of the connector center conductor, dielectric and housing are maintained during use. This technique was sometimes referred to as "epoxy captured contacts".

At the assembly of the cable and connector, the bared end of the cable that was inserted into an accommodating part of the connector, was inserted before the capturing epoxy was applied around the connector parts to fix their positions, and then the cable was soldered to the connector. The capturing epoxy could not be applied before inserting the cable and soldering, because the heat of soldering would so effect the epoxy that it would not be effective to fix the parts in position. At that assembly, when the bared cable was inserted into the connector accommodation, any misalignment of the connector spring finger and cable center conductor would at least force either or both out of position with respect to the outer conductors and so would likely impair electrical performance, or, at worse, bend the very thin cable center conductor so that it either would not contact the connector center conductor spring finger or it would short to the connector housing. As a consequence, fabrication of such cable-connector assemblies suffered a high rejection rate.

As described in my co-pending application, the cable has a conductive ferrule attached to an end to the outer conductor thereof and the outside diameter of the ferrule provides a smooth electrically conductive cylindrical surface. The coaxial connector of the same impedance as the cable has a coaxial recess at one end to accommodate a force fit therein with the outer diameter of the ferrule. At assembly, the ferrule is force-fit into the connector recess while the cable wire-like center conductor that projects from the end of the cable and is enclosed by the ferrule engages an accommodating connector center conductor spring finger and slides inside the finger, making mechanical and electrical connection therewith. The fit between the ferrule and the connector recess is sealed with an epoxy applied to the outside of the connector, sealing the points of connection of the cable and connector conductors inside the connector.

According to my co-pending application, assembling the cable and connector is facilitated using a transverse hole through the housing and dielectric to the center conductor so that epoxy can be inserted therein while the housing and center conductor are held in fixed concentric alignment, so that when the epoxy hardens the aligment is maintained. Thus, the connector contacts are "epoxy captured". Following that step, the ferrule, soldered to the end of the cable, is inserted into the coaxial recess and the center conductor of the cable within the ferrule precisely meets the connector center conductor spring finger. This alignment must be near perfect and must be maintained as the ferrule is force-fit into the recess in the connector housing. An annular recess set back from the inserted end of the ferrule and a counter recess at the entrance to the connector housing recess are provided so that when the ferrule is force fit into the connector housing recess, an annular space is defined at the recess entrance to accept epoxy that seals the fit of the ferrule to the connector and so the electrical connections between the two are sealed within the connector by this epoxy.

SUMMARY OF THE INVENTION

It is an object of the present invention to provide a method and means of construction of an improved coaxial cable and connector assembly for connection to a low impedance (Zl) circuit element of a SHF circuit and in which the cable of the assembly is conventional coaxial cable of low impedance (Zl) and the connector provides a port for connection to a conventional coaxial cable of higher impedance (Zh), the connector being so designed that in operation the VSWR of SHF signals between the port and circuit element does not exceed a maximum of about 1.35: 1.

It is another object of the present invention to provide such a cable and connector assembly with connectors at both ends of the cable so that the user can make of it two cable and connector assemblies for connection to low impedance elements of an SHF circuit providing two ports thereto.

It is another object of the present invention to provide such a cable and connector assembly with connectors at both ends of the cable so that the user can make of it two cable and connector assemblies for connection to YIG filters.

It is an object of the present invention in conjunction with the above to provide a method and means of construction of an improved coaxial cable and connector assembly for connection to a relatively low impedance (Zl) circuit element of a SHF circuit to provide a port thereto for connecting a relatively high impedance (Zh) coaxial cable and in which the assembly of the cable to the connector is accomplished while the connector parts are fixed in position before the cable is inserted into the connector for attachment thereto.

It is another object of the present invention to provide such a Zl to Zh coaxial cable and connector assembly wherein the connector center conductor, dielectric and housing can be fixed in position by capturing epoxy before the Zl cable is inserted into the connector for assembly therewith.

It is another object to provide such a Zl to Zh coaxial cable and connector assembly wherein, the assembly of the cable and connector is accomplished and completed without requiring the application of heat thereto such as in a soldering step.

In accordance with the present invention, a SHF coaxial cable and connector assembly for connection to a ten ohm impedance element of a SHF circuit to provide a coaxial cable port for the element for connection to a conventional fifty ohm coaxial cable includes: a coaxial cable of ten ohm impedance with a conductive ferrule attached to an end of the cable to the outer conductor thereof; and a coaxial connector having a coaxial recess in the housing thereof at one end to accomodate the cable ferrule, into which the ferrule is force-fit to make an intimate metal to metal contact therewith, while the ten ohm cable center conductor engages the connector center conductor within the recess; the inside diameter of the metal walls of the ferrule and the coaxial connector housing from the one end of the connector (where the ferrule is attached) to the other end becoming progressively larger and forming a transformer from ten ohm to fifty ohm coaxial line, so that the other end of the connector is the size of a conventional fifty ohm SHF coaxial cable.

Fabrication of the ten ohm to fifty ohm cable and connector assembly uses a transverse hole through the connector housing and dielectric to the center conductor that is filled with a suitable dielectric epoxy while the housing and center conductor are in proper alignment so that when the epoxy sets, it captures the center conductor maintaining it in alignment with the housing and the housing recess, so it will receive the ten ohm cable center conductor that extends inside the ferrule when the ferrule is force-fit into the housing recess. After force-fitting the ferrule to the connector, the interface between the outer diameter of the ferrule and the housing recess is sealed with epoxy, thereby sealing the electrical connections of the cable and connector within the connector.

The preferred method of constructing this assembly is as described in my co-pending application and includes the steps of drilling a transverse hole through the connector housing and dielectric across the axial hole in the dielectric for the connector center conductor, inserting the connector center conductor into the axial hole and, while the housing and center conductor are held in fixed concentric alignment, inserting liquid epoxy into the transverse hole around the center conductor. When the epoxy hardens the alignment is maintained, and so the connector contacts are "epoxy captured". Following that step, the ferrule soldered to the end of the cable is inserted into the connector coaxial recess provided and the center conductor of the cable within the ferrule precisely meets the connector center conductor spring finger.

In accordance with the present invention, a special connector is provided for the assembly. The connector receives a ferrule (extension) attached to an end of a length of Number 070, 10 ohm coaxial cable (the Zl cable). At one end, the connector has a recess for the ferrule and a spring finger for the cable center conductor. At the other end, the connector has a port for a Number 500, 50 ohm coaxial cable (the Zh cable). Between the recess and the port (from the Zl to the Zh cable) through the connector, the impedance of the connector gradually changes. It increases from 10 ohms to 50 ohms. This change is gradual to insure a relatively low VSWR at the SHF of operation.

These and other objects and features of the present invention are apparent from the accompanying drawings and description.

DESCRIPTION OF EMBODIMENTS OF THE INVENTION

Figure 2:
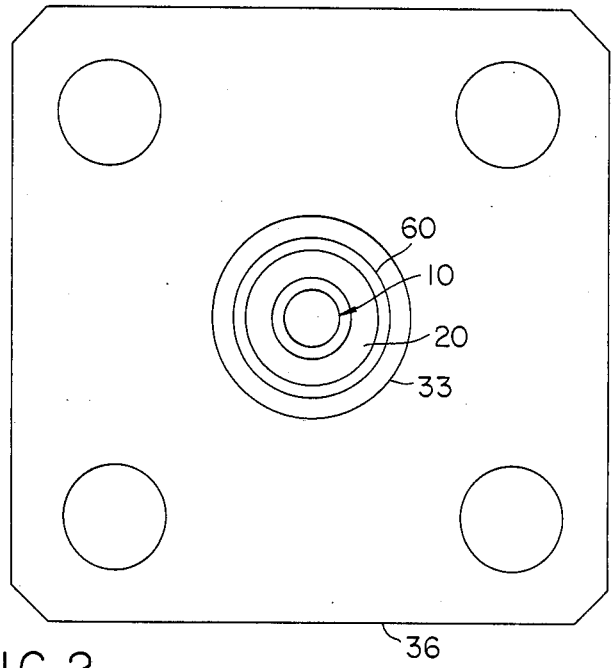
FIG. 2 is an end view of the assembly taken from the cable side thereof.
Figure 1:
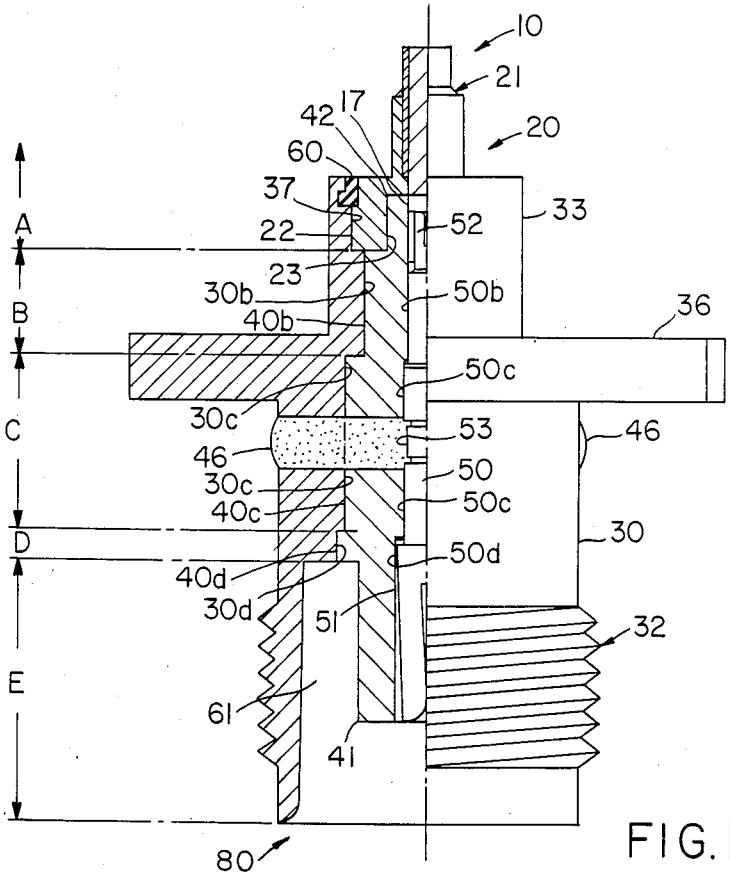
FIG. 1 is a partial longitudinal cross-section view of the coaxial cable and connector assembly for SHF signals that provides a ten ohm cable for connection to a SHF circuit element and a fifty ohm coaxial cable port for conducting SHF signals between the element and port with relatively low VSWR.
Figure 4:
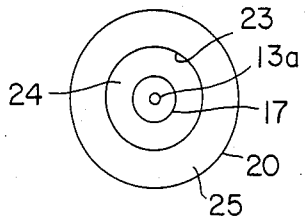
FIG. 4 is an end view of the cable with ferrule attached showing the end of the ferrule that encloses the projecting center conductor of the cable.
Figure 3:
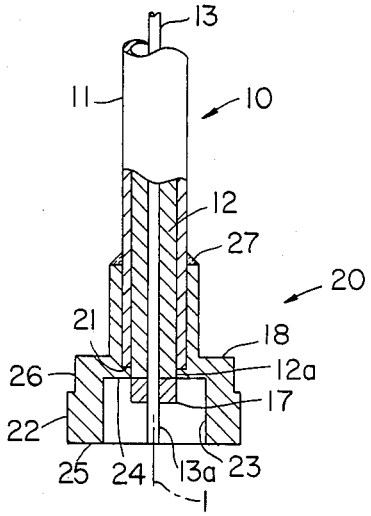
FIG. 3 is a longitudinal cross-section view of the end of the ten ohm cable with the ferrule attached, ready for insertion into the connector.
Figure 5:
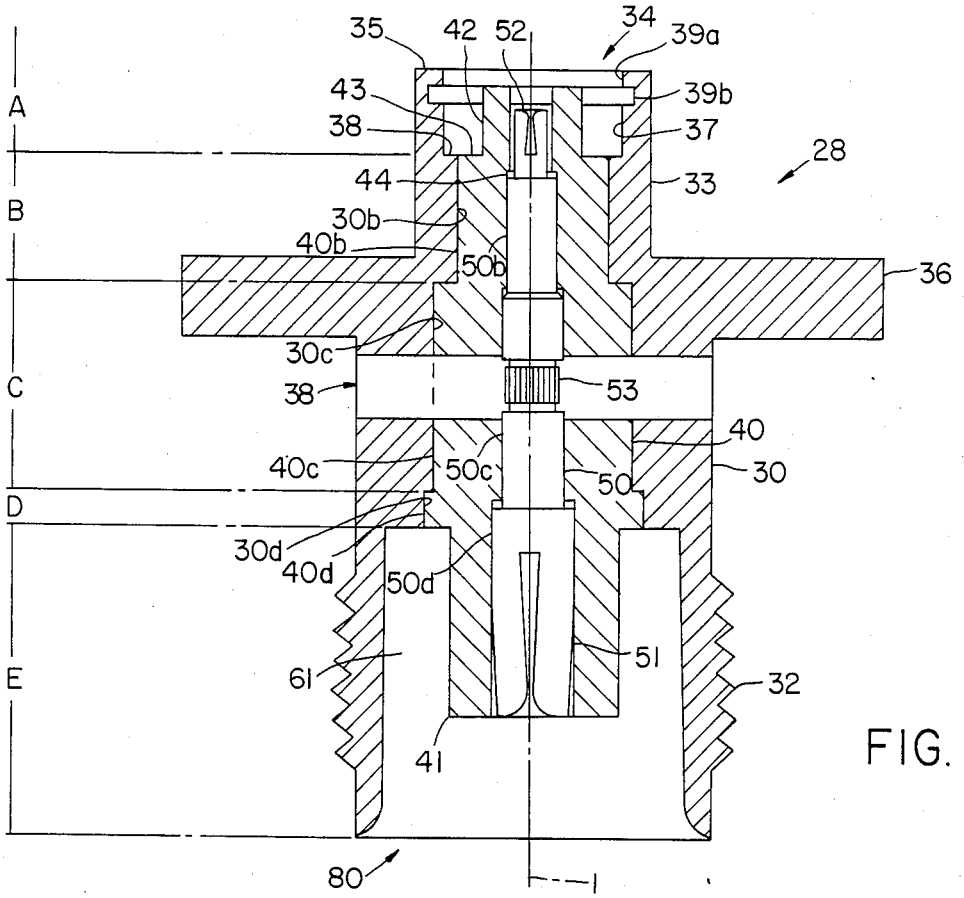
FIG. 5 is a longitudinal cross-section view of the connector before fixing the parts thereof in coaxial alignment with capturing epoxy so that the connector is ready to receive the cable ferrule.

FIGS. 3 and 4 show the end of the SHF cable with a coaxial ferrule attached thereto and ready for assembly with the connector. FIG. 5 shows the connector before the center connector dielectric and housing are fixed in position by capturing epoxy so that the connector is ready to receive the ferrule at the end of the cable. FIGS. 1 and 2 show the completed assembly.

Turning first to FIGS. 3 and 4, there is shown an end of the cable 10 which is, for example, Number 070, 10 ohm SHF cable. The outer conductor 11 is copper about ten thousandths of an inch thick, the dielectric 12 is polytetra flouroethylene (PTFE) and the center conductor 13 is a beryllium copper wire about thirty to fifty thousandths of an inch in diameter and has a silver finish. This cable is prepared for attachment of the ferrule 20 by cutting back the outer conductor and dielectric as shown in FIG. 3, in two steps, exposing a short length of dielectric at 12*a* and a longer length of center conductor at 13*a*. The ferrule 20, a figure of revolution, slides over the prepared end of the cable until an internal shoulder of the ferrule at 21 abuts the cut end of the outer conductor of the cable. Then the ferrule is soldered at 27 to the outer conductor, increasing the outside diameter several times to the outside diameter surface 22 of the ferrule.

The inside wall 23 of the ferrule defines an annular space concentric with the extending end 13*a* of the cable center conductor. The wall 23 bottoms at a sharp inside corner meeting surface 24 that is flush with the cut end of the cable dielectric. The front end 25 of the ferrule is smooth and at right angle to the axis 1 of the cable and ferrule and forms sharp outside corners with the concentric surfaces 22 and 23.

A dielectric ring 17 slightly larger in outside diameter than the cable dielectric 12 fits snugly over the projecting end 13*a* of the cable center conductor and so projects into the inside annular space of the ferrule, short of the projecting cable center conductor. This end of the cable with ferrule attached is then ready for assembly with the connector 28.

The connector 28, ready for the capturing epoxy is shown by FIG. 5. It has a recess 34 at one end for receiving the cable 10 ferrule 20 and a port 80 at the other end for receiving the conventional plug 70 of a conventional Number 500, 50 ohm coaxial cable 71 (see FIG. 7). This connector includes a stainless steel housing 30 with 7/16 inch diameter, 28 threads per inch thread 32 at the port to accommodate the cable plug 70 at that end. A four hole flange 36 is set back from the end that extends from projection 33 that receives the cable ferrule 20. An end view of the flange is shown in FIG. 2.

Within the connector housing 30 is inserted the connector dielectric body 40 and carried within this dielectric is the connector center conductor 50, both of which are essentially figures of revolution about the axis 1. The center conductor 50 has a spring finger at each end for engaging a center conductor. At the port 80 end, the spring finger 51 receives the center conductor 74 of conventional Number 500, 50 ohm coaxial cable 71. Spring finger 51 projects with clearance to expand within the dielectric body 40 at the projecting end 41 thereof.

At the other end of the center conductor 50, within the projection 33, is spring finger 52 that receives the center conductor 13*a* of cable 10. Finger 52 is enclosed with clearance to expand by the concentric projection 42 of dielectric 40 from the shoulder 43 thereof. Both the finger 52 and the dielectric projection 42 project into concentric recess 34 in the face 35 of the projection 33 from flange 36 of the connector housing. This recess is defined in projection 33 by the smooth concentric inside wall 37 and receives the ferrule 20 so that the outside cylindrical surface 22 of the ferrule is a force fit against the inside wall 37 of the recess.

Thus, the wall 37 defines the cylindrical recess 34 athe face 35 of projection 33, into which the projecting dielectric 42 and spring finger 52 project and so the space between 37 and 42 is an annular space that receives the annular shaped ferrule defined by the inside and outside walls 23 and 22 of the ferrule. The bottom of that annular space in the connector that receives the ferrule is formed by a shoulder 38 from which the shoulder 43 of the dielectric 40 may be set back slightly to ensure that the end 25 of the ferrule abuts the housing shoulder 38 and not the dielectric shoulder 43.

The entrance to the recess 34 in projection 33, at 39*a* is slightly widened and is undercut at 39*b* even wider to accommodate liquid epoxy that seals the cable assembly after force fitting the cable ferrule into the connector recess. The ferrule 20 may include a cut back at 26 that is opposite 39*a* and 39*b* of this recess, which together define an annular undercut space to receivthe sealing epoxy.

Figure 6:
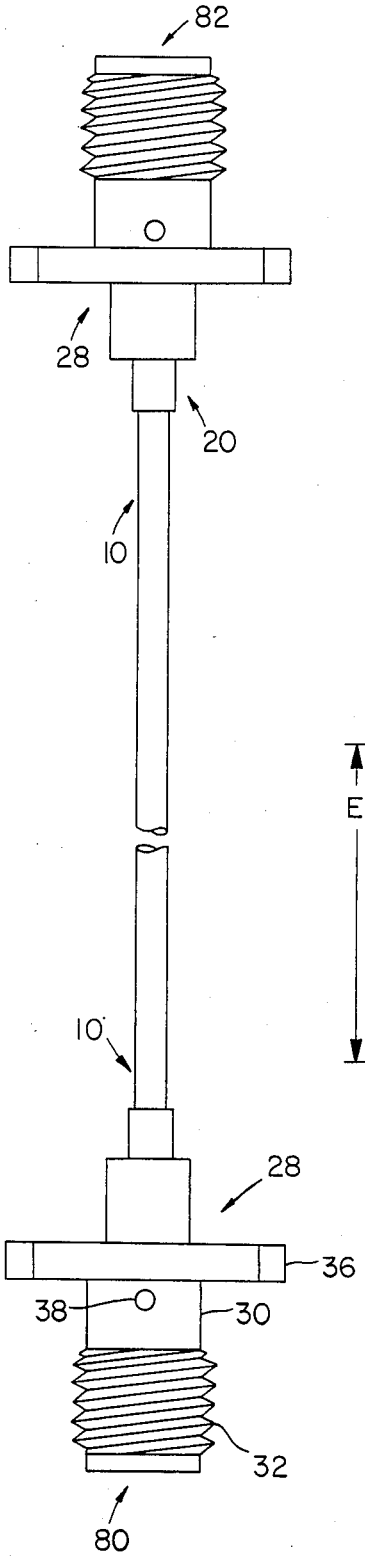
FIG. 6 is a longitudinal view of an assembly of a length of the cable with a connector at each end thereof.
Figure 7:
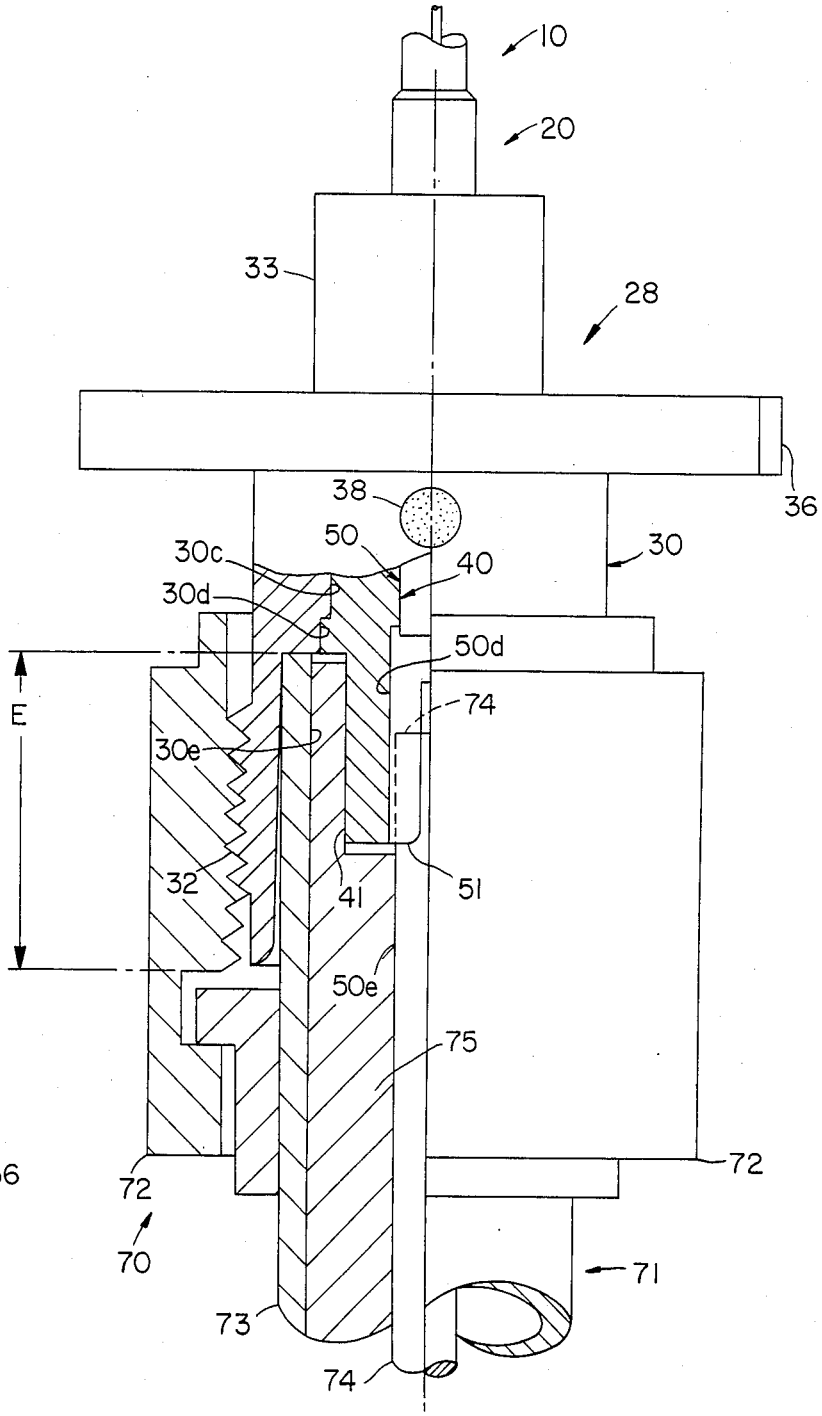
FIG. 7 is a partial longitudinal cross-section view of the connector showing the ten ohm cable and special connector assembly with a fifty ohm cable connected to the fifty ohm port thereof.

Turning next to FIGS. 1, 2, 6 and 7, the drawings show the completed assembly and FIG. 7 shows the assembly with plug 70 of conventional fifty ohm cable 71 plugged into the port provided by connector 28 and secured thereto by cap nut 72. As shown in FIG. 1, the inside diameter of the connector 30 from cable 10 to port 80, beginning at the inside surface 23 of ferrule 20, becomes progressively substantially greater in several steps, while the diameter of center conductor 50 from spring finger 52 to spring finger 51 becomes only slightly greater. Thus, the impedance of the coaxial sections A to D provided by these steps through the connector increase from ten ohms at cable 10 to fifty ohms at port 80. These progressive steps are designed to result in a minimum standing wave reflection (VSWR) for the SHF waves conducted by the cables and connector. By careful design of these steps, the VSWR can be held to no more than 1.35:1 at 0.5 to 8.0 GHz.

The first coaxial section A is the step in the outer conductor (the inside of housing 30) of connector 28 from ten ohm cable 10 within recess 34, inside of ferrule 20, where the outer conductor of the coaxial section is surface 23 and the inner conductor is finger 51. The second coaxial section B is outer conductor surface 30*b* and inner conductor surface 50*b*. The third coaxial section C is outer conductor surface 30*c* and inner conductor surface 50*c*. The fourth coaxial section D is outer conductor surface 30*d* and inner conductor surface 50*d* at the base of spring finger 51. In all of these steps, the outer conductor step is greater than the inner conductor step and precedes the inner conductor step in the direction of larger diameters.

Corresponding steps in the dielectric body 40 are provided so that it is shaped to fit the outer and inner conductor steps. At the first coaxial section A, the dielectric is projection 42 that fills the ferrule against surface 23 and finger 52. At the second section B, the dielectric steps to 40*b*, at the third section C, it steps to 40*c* and at the fourth section D, it steps to 40*d*. From 40*d*, the dielectric projection 41 that encloses finger 51 has a reduced outer diameter and with housing inside surface 31 defines annular space 61. This annular space along with projection 41, finger 51 and threads 32 make up the conventional port 80 for plug 70 of cable 71 (see FIG. 7). As mentioned, cable 71 may be a conventional Number 500, 50 ohm coaxial cable.

Plug 70 is conventional and attaches to cable 71 along with cap nut 72 that screws onto threads 32 of the connector housing as shown in FIG. 7. In port 80, the outer conductor 73 of cable 71 and a portion of the dielectric 75 project into annular space 61 where 73 makes intimate electrical contact with the connector housing and projecting dielectric 75 contacts and encloses projecting dielectric 41 of the connector. At the same time, the cable center conductor 74 fits into the connector spring finger 51. Thus, plug 70, expanded finger 51 and dielectric body projection 41 form a fifth coaxial section E of impedance reduced from section D and equal to the impedance of line 71.

As shown by FIG. 7, the outer conductor diameter of the coaxial line formed, from cable 10 to cable 71 increases to a maximum at section D where the center conductor at spring finger 51 is the greatest diameter and then decreases slightly in plug 70 at the beginning of cable 71 where the center conductor 74 is slightly smaller diameter than spring finger 51. These steps may be designed so that the impedance of sections D and E and cable 71 are all the same (fifty ohms).

Plug 70 is connected to port 80 as described connecting the cable outer and inner conductors to the connector outer and inner conductors as described while the connector threads 32 are engaged by inside threads 76 of cap nut 72 which is held on cable 71 by a shoulder 78 of sleeve 77 attached to the cable. The sleeve shoulder 78 captures nut 72 at inside recess 79 of the nut and when the nut is screwed onto threads 32, the recess bears against shoulder 78 forcing the cable outer conductor and dielectric into connector space 61 and the cable inner conductor into connector spring finger 51.

As mentioned above, the steps that define coaxial sections A to E from cable 10 to cable 71 are of predetermined radial and axial dimension and result in and meet certain performance specifications. The design calculations and tests that I have performed to specify those dimensions are not specifically disclosed herein and can be derived from known theory and design criteria. An embodiment of the invention described herein using Number 070, 10 ohm cable 10 attached as described to connector 28 constructed as described provides a port for the conventional plug of a Number 500, 50 ohm cable 71. When operated at 0.5 to 8.0 GHz this exhibits a VSWR not greater than 1.35:1.

Assembly of line 10 to connector 28 is carried out similar to the assembly procedure and method described in said co-pending application. After inserting dielectric 40 into housing 30, the transverse hole 45 is drilled through the housing and dielectric and then the center conductor 50 is inserted into the dielectric to provide the assembly 28 shown in FIG. 5. When so assembled, the hole 45 meets the slightly recessed part 53 of the center conductor 50. Part 53 may be knurled and slightly recessed as shown, so that it does not impede insertion of the center conductor as a tight fit within the dielectric. The center conductor is inserted into the dielectric from the port 80 end up to a slight shoulder at 44 on the inside of the dielectric.

The purpose of the hole 45 and the recessed knurled part 53 of the center conductor is to receive capturing epoxy when the center conductor 50 is aligned properly coaxially and axially within the connector housing, and thereby fix the center conductor in that position so that it will be aligned properly on the axis 1 and, in particular, the finger 52 that engages the cable center conductor will be aligned concentric with the recess 34 that receives the cable ferrule and so the finger 52 will be aligned properly to receive the center conductor of cable 10. Likewise, at the other end, the finger 51 will be aligned properly on the axis to receive the center conductor of the conventional coaxial cable 71 enclosed by plug 70 that is connected thereto. For this purpose, the knurled part 53 is slightly set back from the rest of the center conductor to insure a flow of capturing epoxy around it and it is knurled to enhance the grip of the epoxy.

The connector housing 30, as mentioned above, is stainless steel and may be plated gold on nickel, particularly on the inside which bounds the electric fields of electric wave signals conducted. The connector dielectric body 40 is preferably Teflon and fits tightly within the housing. The center conductor 50 is gold plated copper.

The assembly of the cable with the connector is shown in FIGS. 1 and 2. Before assembly, the connector housing, dielectric and center conductor are fixed in position by injecting capturing epoxy 46 into hole 45 so that it flows completely through the hole and around part 53 of the center conductor. This is done while the housing and center conductor are held aligned in, for example, a suitable tool. When the epoxy 46 has set, the connector is ready for assembly with cable 10. That assembly is accomplished by inserting the ferrule 20 at the end of the cable into the annular recess 34 at projection 33 defined by cylindrical wall 37 and dielectric projection 42. At that assembly, the ferrule is forced into the annular space of the recess and so the outer surface 22 of the ferrule and surface 37 of the recess in the connector make intimate forced contact. The ferrule is pushed into the recess until the ferrule end 25 bottoms on connector housing shoulder 38. In this engagement, the projecting dielectric 42 fills the inside of the ferrule, fitting snugly around the dielectric ring 17. The extending center conductor 13*a* of the cable fits inside the spring finger 52 making intimate mechanical and electrical contact therewith. When properly inserted the shoulder 18 of the ferrule is flush with the face 35 of projection 33.

When the ferrule is inserted into the connector, as described above, the projecting center conductor 13*a* of the cable aligns perfectly with the spring finger 52 and while the force fit is being accomplished, the alignment is maintained, because the capturing epoxy 46 bonds the connector center conductor, dielectric and housing together. When the ferrule is seated as described within the connector recess 34, the cut back portions 39*a* and 39*b* at the entrance to recess 33 of the connector, and 26 of the ferrule define an undercut annular space to receive the sealing epoxy 60 that seals the electrical connections between the cable and connector within the connector, and also fixes the ferrule to the connector so that it resists forces that would tend to pull the ferrule from the connector. Such forces would have to shear the undercut portion of the epoxy seal 60 in order to pull the ferrule from the connector.

A cable-connector assembly constructed and fabricated as described herein can withstand a pull force on the ferrule of twenty five pounds or more, while the center conductor connection can withstand a pull of ten pounds or more.

A cable such as cable 10 with a ferrule such as 20 at each end, attached to a connector such as 28 at each end, is shown in FIG. 6. This assembly provides the user two cable and connector assemblies. For example, the user may cut the cable at just about any place between the two connectors and then prepare the cut end of the cable as described in said co-pending application for attachment to a low impedance SHF circuit element to provide a coaxial port 80 for the element. Thus, the assembly shown in FIG. 6 provides the user the parts for two SHF ports. FIG. 7 shows one of these connections providing port 80 for the conventional Number 500, 50 ohm coaxial cable 71 plugged into the port and secured by plug nut 72 to provide a low VSWR connection of cable 71 to the SHF circuit element. The other port 82 may be used to provide another such port for the circuit.

Other configurations of the Zl to Zh impedance cable and connector assembly for providing a Zh impedance port for a conventional coaxial cable having low VSWR at SHF may occur to those skilled in the art within the spirit and scope of the present invention and so the invention is not to be construed as limited in its scope except as set forth in the appended claims.

What is claimed is:

1. A SHF coaxial cable and connector assembly for connection to a relatively low impedance (Zl) SHF circuit element to provide said element with a coaxial connector port of greater impedance (Zh) for efficiently conducting SHF signals to or from said circuit element comprising, (a) a coaxial cable having an outer conductor, dielectric and center conductor of SHF impedance Zl, (b) an electrically conductive extension attached to one end of said Zl impedance cable to said outer conductor thereof providing an extension coaxial outer conductor surface of greater inside diameter than said Zl cable outer conductor into which said one end of said Zl cable center conductor extends as the center conductor of said extension, (c) a coaxial connector having an outer conductor housing, dielectric and center conductor, (d) a coaxial recess at one end of said connector outer conductor housing into which said Zl cable extension projects, (e) a coaxial connector port of impedance Zh at the other end of said connector defined by said connector outer conductor housing, dielectric and center conductor and (f) between said Zl cable extension at said one end and said coaxial connector port at said other end, said connector housing outer conductor, dielectric and center conductor being constructed so that the impedance of the coaxial transmission line sections formed thereby increases toward said port end, (g) whereby the VSWR of SHF signals conducted between said Zl impedance coaxial cable and said coaxial connector port when a Zh impedance coaxial cable is connected thereto is suitably low.

2. A SHF coaxial cable and connector assembly as in claim 1 wherein, (a) said impedance of said coaxial transmission line sections formed in said connector is shaped to provide a gradual increase in impedance toward said connector port.

3. A SHF coaxial cable and connector assembly as in claim 2 wherein, (a) said coaxial transmission line sections impedances increase due to increases in the diameter of said sections outer conductor.

4. A SHF coaxial cable and connector assembly as in claim 2 wherein, (a) said connector coaxial transmission line sections impedances that gradually increase, increase in several discrete steps.

5. A SHF coaxial cable and connector assembly as in claim 4 wherein, (a) said coaxial transmission line sections impedances increase due to increases in the diameter of said sections outer conductor.

6. A SHF coaxial cable and connector assembly as in claim 4 wherein, (a) the diameter of said sections inner conductor between said Zl cable and said connector port changes.

7. A SHF coaxial cable and connector assembly as in claim 4 wherein, (a) the diameter of said sections inner conductors also changes in discrete steps.

8. A SHF coaxial cable and connector assembly as in claim 7 wherein, (a) each step in said connector sections center conductor corresponds to a step in said diameter of said sections outer conductor between said Zl cable and said connector port increases in several steps.

9. A SHF coaxial cable and connector assembly as in claim 8 wherein, (a) said steps in said sections outer conductor from said Zl cable to said connector port each precedes said corresponding steps in said center conductor.

10. A SHF coaxial cable and connector assembly as in claim 7 wherein, (a) there are at least three of said discrete steps.

11. A SHF coaxial cable and connector assembly as in claim 1 wherein, (a) said coaxial cable extension is an electrically conductive ferrule attached to an end of said Zl cable to said outer conductor thereof defining an annular space beyond the end of said cable outer conductor and dielectric into which the end of said cable center conductor extends, (b) the dimensions of said ferrule and said connector recess being such that said ferrule is a force-fit into said recess and (c) said connector center conductor and said extending cable center conductor are so constructed that they are mechanically and electrically connected.

12. A SHF coaxial cable and connector assembly as in claim 11 wherein, (a) said connector center conductor has a spring finger at said one end that projects into said connector housing recess and is adapted to receive said extending cable center conductor as said ferrule is forced into said recess.

13. A SHF coaxial cable and conductor assembly as in claim 11 wherein, (a) said connector dielectric at said one end thereof projects into said connector recess and is adapted to fit into the inside of said ferrule around said projecting cable center conductor.

14. A SHF coaxial cable and connector assembly as in claim 11 wherein, (a) a space is provided within said connector through said connector housing and dielectric and around said connector center conductor and (b) said space is filled with a capturing epoxy dielectric, (c) whereby said connector center conductor is fixed in position with respect to said connector center conductor housing and recess.

* * * * *